US009108702B2

(12) United States Patent
Ottolini

(10) Patent No.: US 9,108,702 B2
(45) Date of Patent: Aug. 18, 2015

(54) MOORING ASSEMBLY FOR A VESSEL

(75) Inventor: Patrizio Giovanni Matia Ottolini, Voorhout (NL)

(73) Assignee: Bluewater Energy Services B.V., Hoofddorp (NL)

( * ) Notice: Subject to any disclaimer, the term of this patent is extended or adjusted under 35 U.S.C. 154(b) by 0 days.

(21) Appl. No.: 14/122,477

(22) PCT Filed: May 30, 2011

(86) PCT No.: PCT/EP2011/058811
§ 371 (c)(1),
(2), (4) Date: Jan. 31, 2014

(87) PCT Pub. No.: WO2012/163394
PCT Pub. Date: Dec. 6, 2012

(65) Prior Publication Data

US 2014/0216322 A1 Aug. 7, 2014

(51) Int. Cl.
*B63B 21/00* (2006.01)
*B63B 21/50* (2006.01)

(52) U.S. Cl.
CPC ..... *B63B 21/507* (2013.01)

(58) Field of Classification Search
CPC ..... B63B 21/00; B63B 21/507
USPC ..... 114/230.1, 230.12
See application file for complete search history.

(56) References Cited

U.S. PATENT DOCUMENTS

| | | | | |
|---|---|---|---|---|
| 4,305,341 | A | 12/1981 | Stafford | |
| 4,701,143 | A | 10/1987 | Key | |
| 4,841,895 | A | 6/1989 | Brewerton | |
| 4,955,310 | A | 9/1990 | Pollack | |
| 5,065,689 | A | 11/1991 | Krogstad | |
| 5,178,087 | A | 1/1993 | O'Nion et al. | |
| 5,381,750 | A | 1/1995 | Pollack | |
| 5,893,784 | A * | 4/1999 | Boatman | 441/3 |
| 6,708,639 | B2 * | 3/2004 | Cottrell et al. | 114/230.12 |
| 7,225,749 | B2 * | 6/2007 | Boatman | 114/230.12 |
| 2002/0073906 | A1 | 6/2002 | Hobdy | |
| 2004/0261683 | A1 | 12/2004 | Lindblade | |
| 2005/0061224 | A1 | 3/2005 | Boatman | |

FOREIGN PATENT DOCUMENTS

| | | | |
|---|---|---|---|
| EP | 0259072 | A1 | 3/1988 |
| EP | 0656293 | A | 6/1995 |
| WO | 87/06555 | A1 | 11/1987 |
| WO | 89/03338 | A1 | 4/1989 |

OTHER PUBLICATIONS

International Search Report and Written Opinion for PCT/EP2011/058811, May 30, 2012 in the European Patent Office.

* cited by examiner

*Primary Examiner* — Daniel V Venne
(74) *Attorney, Agent, or Firm* — Steven M. Koehler; Westman, Champlin & Koehler, P.A.

(57) ABSTRACT

In a mooring assembly for a vessel, comprising a moonpool defined in the vessel, a turret is rotatably mounted within the moonpool with an upper main bearing for transmitting horizontal and vertical loads between the vessel and turret and with a lower secondary bearing for substantially transmitting horizontal loads between the vessel and the turret. Mooring lines are attached to the lower region of the turret that comprises a number of circumferentially spaced torsion box like torsion members each extending substantially vertically. The torsion members resist bending in a circumferential direction that is greater than in a radial direction. The lower secondary bearing is defined by outwardly facing bearing members attached to said torsion members and an inwardly facing bearing ring attached to the moonpool. In a situation in which a torsion member is not loaded horizontally by a respective mooring line its bearing member does not engage the ring.

22 Claims, 1 Drawing Sheet

MOORING ASSEMBLY FOR A VESSEL

CROSS-REFERENCE TO RELATED APPLICATION

This application is a Section 371 National Stage Application of International Application PCT/EP2011/058811 filed May 30, 2011 and published as WO2012/163394 A1 in English.

BACKGROUND

The discussion below is merely provided for general background information and is not intended to be used as an aid in determining the scope of the claimed subject matter.

The invention relates to a mooring assembly for a vessel, comprising a moonpool defined in the vessel, a turret rotatably mounted within the moonpool by means of an upper main bearing for transmitting horizontal and vertical loads between the vessel and turret and by means of a lower secondary bearing for substantially transmitting horizontal loads between the vessel and the turret, and mooring lines attached to the lower region of the turret.

Ideally the lower secondary bearing transmits the major part of the mooring forces (which are caused by the mooring lines) in a horizontal direction to the vessel. Practically, however, it is difficult to avoid that a substantial part of these forces are reacted by the upper main bearing, causing severe stresses, particularly in the turret and in the upper main bearing.

One suggested solution for this problem is to decrease the diameter of at least a lower part of the turret such as to reduce its resistance against bending. As a result the turret may bend under horizontal mooring forces, causing the lower secondary bearing to transmit most of the horizontal loads. A disadvantage, however, is that such a reduction of diameter of the turret reduces the available space for risers (or other elements such as, for example, a disconnectable buoy member) Further such a reduction of diameter may decrease the ability of the turret to transmit circumferential loads.

SUMMARY

This Summary and the Abstract herein are provided to introduce a selection of concepts in a simplified form that are further described below in the Detailed Description. This Summary and the Abstract are not intended to identify key features or essential features of the claimed subject matter, nor are they intended to be used as an aid in determining the scope of the claimed subject matter. The claimed subject matter is not limited to implementations that solve any or all disadvantages noted in the Background In accordance with an aspect of the present invention, the mooring assembly includes a turret that at its lower region comprises a number of circumferentially spaced torsion box like torsion members each extending substantially vertically between an upper end attached to the turret and a lower free end, which torsion members have a resistance against bending that in a circumferential direction is greater than in a radial direction, wherein the mooring lines are attached to said torsion members near said lower free ends and wherein the lower secondary bearing is defined by outwardly facing bearing members attached to said torsion members and an inwardly facing bearing ring attached to the moonpool, and wherein in a situation in which a torsion member is not loaded horizontally by a respective mooring line its bearing member does not engage the bearing ring.

The torsion members offers a simple design, however combined with the provision of flexibility which at one hand allows the torsion members to bend outwardly into contact with the bearing ring (avoiding the transmission of horizontal loads to the upper main bearing) and at the other hand offers sufficient rigidity in the circumferential direction to transmit circumferential loads to the turret (and to whatever constructional and/or operational parts supported thereby). Because, further, this design does not require a reduction of the diameter of any part of the turret, the available space for risers is optimised. The torsion box design results in a torsion stiffness which ensures full contact between the bearing members and effectively avoids undesired phenomena, such as fretting between the bearing members and the bearing ring due to dynamic stick-slip effects. As a result the bearing members and bearing ring are maintained in full engagement.

The gap present between a bearing member and the bearing ring in a situation in which a torsion member is not loaded horizontally by a respective mooring line moreover allows hogging and sagging of the vessel with a resulting change of the gap dimension without effecting the horizontal load distribution over the upper main bearing and the lower secondary bearing.

In one embodiment of the mooring assembly, the torsion members taper in a vertical direction, for example upwardly. Such a taper allows the mooring assembly, and specifically the turret, to be optimised, both in a constructional and spatial sense.

In another embodiment of the mooring assembly the ratio between the resistance of the torsion members against bending in a circumferential direction and in a radial direction is at least five.

There are several possibilities for controlling the manner in which the torsion members will bend when loaded. For example it is possible that the spacing between successive torsion members have different lengths and/or widths.

In yet another embodiment of the mooring assembly, the bearing members are friction pads.

In an embodiment of the mooring assembly, the lower secondary bearing is located at the lower free ends of the torsion members wherein the position where the mooring lines are attached to the turret substantially is located at the same level. Thus the mooring lines engage the torsion members near to the lower secondary bearing, such that mooring loads are almost directly directed to the lower secondary bearing without loading the turret in an excessive manner.

However, alternatively it is possible that the lower secondary bearing is located above the lower free ends of the torsion members at a higher level than the position where the mooring lines are attached to the turret. In such a case the torsion members must be sufficiently flexible to be moved radially outward when loaded, but also sufficiently rigid to prevent an engagement between the lowermost part of a torsion member (below said secondary bearing) and the moonpool.

It is also possible that the torsion members have different cross sections, for example when one expects the mooring assembly to be loaded in an asymmetrical manner (caused, for example, by a predominant direction of a sea current or wind).

Finally an embodiment of the mooring assembly is mentioned in which the turret comprises a lower turret section and an upper turret section and wherein the lower turret section is detachable from the upper turret section. For example the lower turret section may be part of or may define a detachable buoy member which may support the risers.

BRIEF DESCRIPTION OF THE DRAWINGS

Hereinafter aspects of the invention will be elucidated while referring to the drawing, in which FIG. 1 schematically shows an embodiment of a mooring assembly in a side elevational view, and FIG. 2 schematically shows a partial cross section according to II-II in FIG. 1.

DETAILED DESCRIPTION

Figure 1:
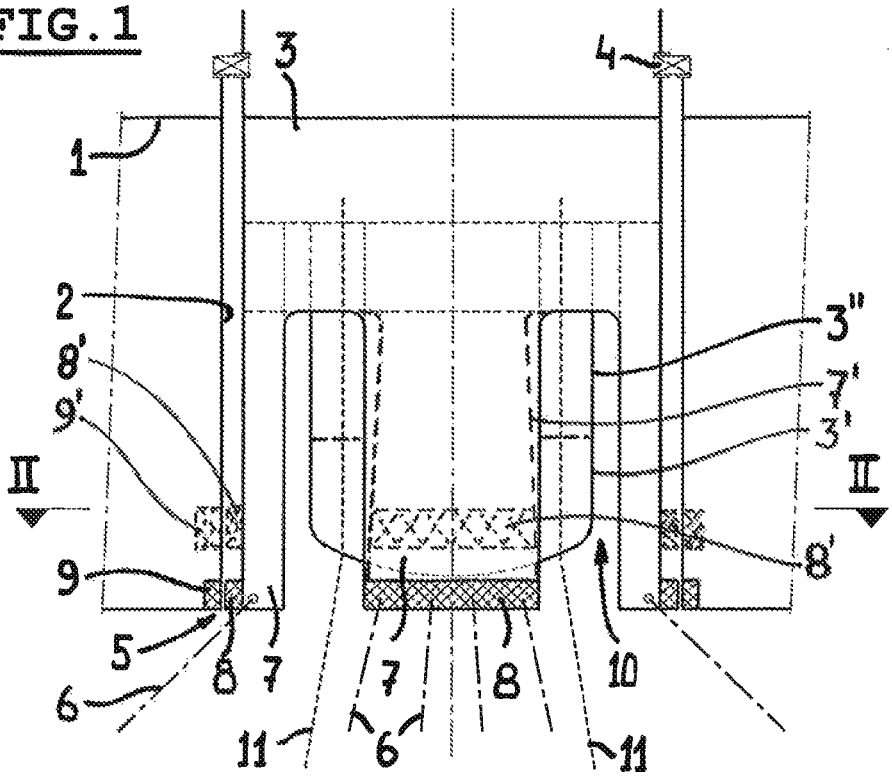

Firstly referring to FIG. 1 a mooring assembly for a vessel 1 is illustrated schematically. It comprises a moonpool 2 defined in the vessel, a turret 3 rotatably mounted within the moonpool by means of an upper main bearing 4 for transmitting horizontal and vertical loads between the vessel and turret and by means of a lower secondary bearing 5 for substantially transmitting horizontal loads between the vessel and the turret.

Figure 2:
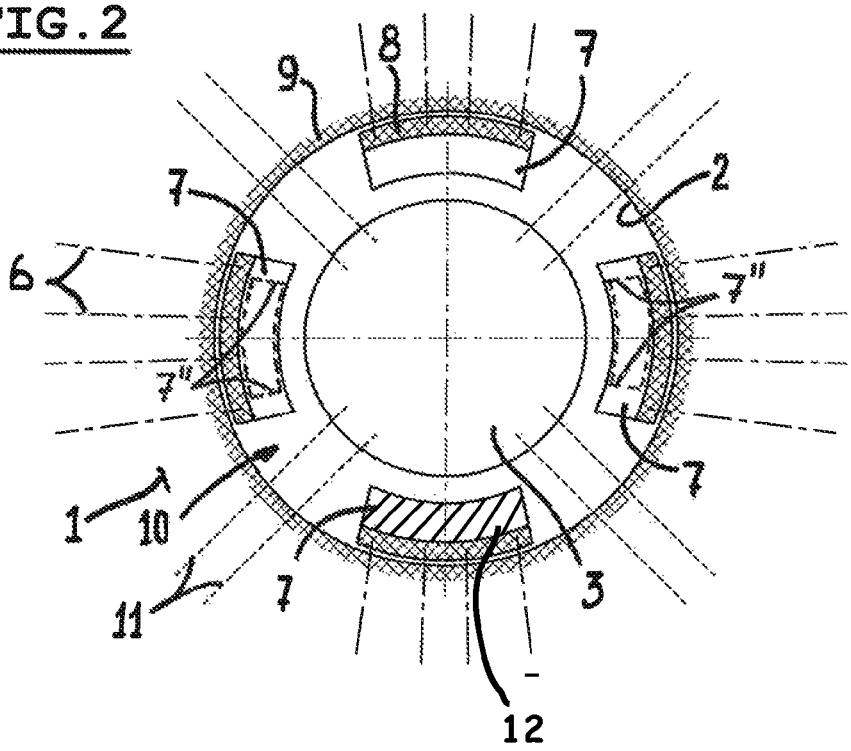

As may appear more clearly from FIG. 2, the turret 3 at its lower region comprises a number of circumferentially spaced torsion box like torsion members 7 each extending substantially vertically between an upper end attached to the turret 3 and a lower free end. These torsion members 7 are designed in such a manner that they have a resistance against bending that in a circumferential direction is greater than in a radial direction. These resistances may differ at least by a factor of five.

Mooring lines 6 are attached to said torsion members 7 near said lower free ends of the torsion members 7.

The lower secondary bearing 5 is defined by outwardly facing bearing members 8 attached to said lower free ends of the torsion members 7 and an inwardly facing bearing ring 9 attached to the wall of the moonpool 2. Preferably the bearing members 8 are friction pads. In a situation in which a torsion member 7 is not loaded horizontally by a respective mooring line 6 (as illustrated in FIGS. 1 and 2) its bearing member 8 does not engage the bearing ring 9. Under a sufficiently large horizontal (outward) load, however, such a flexible torsion member 7 will bend outwardly and its bearing member 8 will engage the bearing ring 9, thus activating the lower secondary bearing 5 and keeping the resulting load on the upper main bearing 4 as small as possible.

Torsion of the torsion members 7 is avoided because of the torsion box design. This maintains a full engagement between the bearing members 8 and bearing ring 9.

As appears clearly from FIG. 1 the spacing 10 between two successive torsion members 7 extends substantially vertically but conceivable are other orientations and shapes too.

The length of the spacing 10 may differ from what has been illustrated. Moreover some spacings may have different lengths and/or widths.

The torsion members 7, which define torsion boxes comprising among others (in a known manner and thus not further elucidated here) opposite wall sections and internal stiffening members, 12 one of which is shown cross-hatched, may taper vertically, for example upwardly, as illustrated by the dotted outline of a tapering torsion member 7' in FIG. 1. Further their cross section may differ between different torsion members 7, as illustrated by the dotted less wider cross section of two opposite torsion members 7" in FIG. 2. The lower secondary bearing may be located above the lower free ends of the torsion members 7 at a higher level than a position where the mooring lines 6 are attached to the turret 3, as illustrated by the position of the bearing members 8' and the bearing ring 9' in FIG. 1.

The turret 3 may comprise a lower turret section 3' and an upper turret section 3" (see FIG. 1) wherein the lower turret section is detachable from the upper turret section. For example such a lower turret section may be part of or may define a detachable buoy member supporting risers 11 in a manner known per se.

The invention is not limited to the embodiments described above which may be varied widely within the scope of the invention as defined by the attached claims.

The invention claimed is:

1. A mooring assembly for a vessel, comprising:

a moonpool defined in the vessel, a turret rotatably mounted within the moonpool with an upper main bearing configured to transmit horizontal and vertical loads between the vessel and turret and with a lower secondary bearing configured to substantially transmit horizontal loads between the vessel and the turret, wherein at a lower region of the turret the turret comprises a number of circumferentially spaced torsion members, each torsion member comprising a torsion box and extending substantially vertically between an upper end of the torsion member attached to the turret and a lower free end of the torsion member, wherein the torsion members have a resistance against bending that in a circumferential direction is greater than in a radial direction, and mooring lines attached to the lower region of the turret, wherein the mooring lines are attached to the torsion members near the lower free ends and wherein the lower secondary bearing comprises outwardly facing bearing members attached to the torsion members and an inwardly facing bearing ring attached to the moonpool, and wherein in a situation in which a torsion member is not loaded horizontally by a respective mooring line an associated outwardly facing bearing member does not engage the inwardly facing bearing ring.

2. The mooring assembly according to claim 1, wherein the torsion members taper in a vertical direction.

3. The mooring assembly according to claim 2, wherein the torsion members taper upwardly.

4. The mooring assembly according to claim 1, wherein a ratio between resistance of the torsion members against bending in a circumferential direction and in a radial direction is at least five.

5. The mooring assembly according to claim 1, wherein the outwardly facing bearing members are friction pads.

6. The mooring assembly according to claim 1, wherein the lower secondary bearing is located at a level of the lower free ends of the torsion members and wherein a position where the mooring lines are attached to the turret substantially is located at the same level of the lower free ends.

7. The mooring assembly according to claim 1, wherein the lower secondary bearing is located above the lower free ends of the torsion members at a higher level than a position where the mooring lines are attached to the turret.

8. The mooring assembly according to claim 1, wherein the torsion members have different cross sections.

9. The mooring assembly according to claim 1, wherein the turret comprises a lower turret section and an upper turret section and wherein the lower turret section is detachable from the upper turret section.

10. The mooring assembly according to claim 9, wherein the lower turret section is part of or defines a detachable buoy member.

11. A mooring assembly for a vessel, comprising:

a moonpool defined in the vessel, a turret rotatably mounted within the moonpool with an upper main bearing configured to transmit horizontal and vertical loads between the vessel and turret and with a lower secondary bearing configured to substantially transmit horizontal loads between the vessel and the turret, wherein at a lower region of the turret the turret comprises a number of circumferentially spaced torsion members, each torsion member comprising an elongated torsion box formed from connected walls extending longitudinally, the elongated torsion box extending substantially vertically between an upper end of the torsion member attached to the turret and a lower free end of the torsion member, and mooring lines attached to the lower region of the turret, wherein the mooring lines are attached to the torsion members near the lower free ends and wherein the lower secondary bearing comprises outwardly facing bearing members attached to the torsion members and an inwardly facing bearing ring attached to the moonpool, and wherein in a situation in which a torsion member is not loaded horizontally by a respective mooring line an associated outwardly facing bearing member does not engage the inwardly facing bearing ring.

12. The mooring assembly according to claim 11, wherein the torsion members taper in a vertical direction.

13. The mooring assembly according to claim 12, wherein the torsion members taper upwardly.

14. The mooring assembly according to claim 11, wherein a ratio between resistance of the torsion members against bending in a circumferential direction and in a radial direction is at least five.

15. The mooring assembly according to claim 11, wherein the outwardly facing bearing members are friction pads.

16. The mooring assembly according to claim 11, wherein the lower secondary bearing is located at a level of the lower free ends of the torsion members and wherein a position where the mooring lines are attached to the turret substantially is located at the same level of the lower free ends.

17. The mooring assembly according to claim 11, wherein the lower secondary bearing is located above the lower free ends of the torsion members at a higher level than a position where the mooring lines are attached to the turret.

18. The mooring assembly according to claim 11, wherein the torsion members have different cross sections.

19. The mooring assembly according to claim 11, wherein the turret comprises a lower turret section and an upper turret section and wherein the lower turret section is detachable from the upper turret section.

20. The mooring assembly according to claim 19, wherein the lower turret section is part of or defines a detachable buoy member.

21. The mooring assembly according to claim 11, wherein the torsion members have a resistance against bending that in a circumferential direction is greater than in a radial direction.

22. The mooring assembly according to claim 11, wherein each torsion member further comprises an internal stiffening member disposed in the torsion box.

* * * * *